US006919675B2

(12) United States Patent
Uchida et al.

(10) Patent No.: US 6,919,675 B2
(45) Date of Patent: Jul. 19, 2005

(54) COLOR CATHODE RAY TUBE

(75) Inventors: Go Uchida, Mobara (JP); Kenichi Watanabe, Ootaki (JP); Shoji Shirai, Mobara (JP); Kazunari Noguchi, Chiba (JP)

(73) Assignee: Hitachi, Ltd., Chiba-ken (JP)

( * ) Notice: Subject to any disclaimer, the term of this patent is extended or adjusted under 35 U.S.C. 154(b) by 142 days.

(21) Appl. No.: 10/644,304

(22) Filed: Aug. 20, 2003

(65) Prior Publication Data

US 2004/0041511 A1 Mar. 4, 2004

(51) Int. Cl.[7] ..... H01J 29/50
(52) U.S. Cl. ..... 313/414; 313/412
(58) Field of Search ..... 313/412, 413, 313/414, 425, 452, 458

(56) References Cited

U.S. PATENT DOCUMENTS 5,600,201 A * 2/1997 Yun et al. ..... 313/414

6,825,621 B2 * 11/2004 Song et al. ..... 315/368.16

* cited by examiner

*Primary Examiner*—Vip Patel
(74) *Attorney, Agent, or Firm*—Milbank, Tweed, Hadley & McCloy, LLP

(57) ABSTRACT

In an electron gun including a cathode, a control electrode, an acceleration electrode G2, a focusing electrode G3 and an anode, longitudinally elongated concave SL-V which surround an electron beam aperture G2-H and have a long axis in the vertical direction is formed at a focusing electrode G3 side of the acceleration electrode G2, and an electron beam aperture G3-BH formed at the acceleration electrode G2 side of the focusing electrode G3 is formed in a longitudinally elongated shape having a long axis in the vertical direction. Due to such a constitution of the present invention, non-uniformity of the beam spot shape attributed to a deflection quantity can be reduced whereby the optimum focusing can be realized over the whole area of a screen.

9 Claims, 9 Drawing Sheets

COLOR CATHODE RAY TUBE

BACKGROUND OF THE INVENTION

1. Field of the Invention

The present invention relates to a color cathode ray tube, and more particularly to a color cathode ray tube which realizes an optimum focusing on the whole screen by decreasing the non-uniformity of beam spot shape attributed to a deflection quantity.

2. Description of the Related Art

In general, a color cathode ray tube is constituted of a vacuum envelope which is comprised of a panel portion forming a display part (a phosphor screen or a screen), a narrow-diameter neck portion and a funnel-like funnel portion which connects the panel portion and the neck portion, and a deflection yoke is mounted on an outer portion of a connecting area between the panel portion and the neck portion. On an inner surface of the panel portion which constitutes the screen, a phosphor surface (a phosphor screen) which is formed by applying phosphors of three colors consisting of red, green and blue usually is formed. In a so-called shadow mask type, a shadow mask which constitutes a color selection electrode is arranged close to the phosphor screen.

Further, in the inside of the neck portion, an electron gun which emits three electron beams corresponding to the above-mentioned phosphors of three colors in parallel in the horizontal direction is usually housed. By allowing three electron beams emitted from this electron gun to pass through beam apertures formed in the shadow mask, three electron beams are made to impinge on the phosphors of three colors constituting the phosphor screen so that a color image is reproduced.

The electron gun housed inside the above-mentioned neck portion includes an electron beam generating part (a triode part) which sequentially arranges a cathode, a control electrode which is arranged close to the cathode and has three respective electron beam apertures consisting of a center electron beam aperture and side electron beam apertures in an in-line arrangement in a state that these beam apertures respectively face the cathode and an accelerating electrode, and a focusing electrode and an anode for focusing and accelerating electron beams generated by the electron beam generating part.

FIG. 10 is a schematic cross-sectional view for explaining one constitutional example of an electron gun in a conventional color cathode ray tube. In the drawing, an electron beam generating part (a triode part) is constituted of a cathode K which is heated by a heater H, a first electrode G1 which constitutes a control electrode and a second electrode G2 which constitutes an accelerating electrode. Electrons which are generated by the cathode K are formed into electron beams B after passing through the triode part. The electron beams B pass through a pre-focusing lens which is formed by a focusing electrode constituted of a third electrode G3, a fourth electrode G4 and a fifth electrode G5, and is emitted in the direction toward a phosphor screen from a main focusing lens which is formed between the fifth electrode G5 and a sixth electrode G6 which constitutes an anode. Here, SC indicates a shielding cup. FIG. 10 shows a cross section in the vertical direction (longitudinal direction) V with respect to the center beam among three electron beams emitted in parallel in the horizontal direction (lateral direction) H. The same goes for respective drawings described hereinafter.

Reference symbol G1-H indicates an electron beam aperture of the first electrode G1, reference symbol G2-H indicates an electron beam aperture of the second electrode G2, reference symbol G3-BH indicates electron beam apertures formed in the second electrode G2 side of the third electrode G3, that is, electron beam apertures formed in a bottom of the third electrode, reference symbol G3-TH indicates electron beam apertures formed in the fourth electrode G4 side of the third electrode G3, that is, electron beam apertures formed in a top of the third electrode, reference symbol G4-H indicates electron beam apertures formed in the fourth electrode G4, reference symbol G5-BH indicates electron beam apertures formed in the fourth electrode G4 side of the fifth electrode G5, that is, electron beam apertures formed in a bottom of the fifth electrode, reference symbol G5-TH indicates electron beam apertures formed in the sixth electrode G6 side of the fifth electrode G5, that is, electron beam apertures formed in a top of the fifth electrode, reference symbol G6-BH indicates electron beam apertures formed in the fifth electrode G5 side of the sixth electrode G6, that is, electron beam apertures formed in a bottom of the sixth electrode, and reference symbol SC-H indicates electron beam apertures formed in the shielding cup SC. Here, the electron gun shown in FIG. 10 constitutes merely one example and various modifications are considered as the electrode constitution ranging from the focusing electrode to the anode.

FIG. 11A and FIG. 11B are schematic plan views for explaining the constitutions of the second electrode and the third electrode shown in FIG. 10. That is, FIG. 11A is a plan view of the second electrode G2 as viewed from the first electrode G1 side, that is, the bottom side of the second electrode, while FIG. 11B is a plan view of the third electrode G3 as viewed from the second electrode G2 side, that is, the bottom side of the third electrode. In a bottom G2-B of the second electrode G2, laterally-elongated concave SL-H having a long axis in the horizontal direction are formed such that the laterally-elongated concave SL-H surround the electron beam apertures G2-H. On the other hand, in a bottom G3-B of the third electrode G3, longitudinally elongated electron beam apertures G3-BH having a long axis in the vertical direction V are formed.

Further, in an electron gun described in the U.S. Pat. No. 5,600,201 specification, electron beam apertures formed in a first electrode G1 are laterally elongated having a long axis in the horizontal direction, and a second electrode G2 has laterally-elongated concave having a long axis in the horizontal direction at the first electrode G1 side while surrounding the electron beam apertures, and key-hole-shaped apertures each of which is formed by providing elongated open apertures extending in the upward and downward directions to a circular opening are formed in the bottom of the third electrode G3. Here, the combined structure in which laterally-elongated concave which surround the electron beam apertures are formed at the bottom or the top of the second electrode G2, and longitudinally elongated electron beam apertures or longitudinally elongated concave which surround the electron beam apertures are formed in the bottom of the third electrode G3 is also known.

SUMMARY OF THE INVENTION

In an electron gun which combines the laterally-elongated concave formed in the top of the second electrode G2 and the longitudinally elongated electron beam aperture formed in the bottom of the third electrode G3, it has been observed that the luminance of halo which is generated in the lateral direction in the periphery of the screen (that is, the phosphor screen) becomes thick so that focusing at the peripheral portion on the screen is degraded. Accordingly, when the laterally-elongated concave is formed in the bottom of the second electrode G2, it has been observed that the above-mentioned luminance of halo generated in the lateral direction in the periphery of the screen becomes thin so that focusing at the peripheral portion is enhanced.

However, since the concave is formed at the first electrode G1 side, a distance between the electron beam aperture of the first electrode G1 and the electron beam aperture of the second electrode G2 is increased and hence, focusing at the center portion of the screen is degraded. Further, when the distance between the electron beam apertures of the first electrode G1 and the second electrode G2 is increased, the dependency of the focusing voltage on current is increased and hence, focusing at the low luminance or the high luminance is degraded. Overcoming of such a drawback has been one of tasks to be solved.

Accordingly, present invention can obtain a color cathode ray tube having an electron gun which can overcome the above-mentioned task attributed to the conventional electron gun and can realize favorable focusing over the whole area of the screen.

In a cathode ray tube of the present invention, a focusing electrode (a third electrode G3) side face of a second electrode G2 which constitutes an accelerating electrode, that is, a second electrode top has concave which have a long axis in the vertical direction surrounding electron beam aperture, and electron beam aperture formed in a bottom portion of the third electrode are formed in the longitudinally elongated shape having a long axis in the vertical direction.

Further, in addition to the above-mentioned constitution, the electron beam aperture formed in the first electrode G1 have a shape with a long axis arranged in the horizontal direction, and the electron beam aperture formed in the second electrode G2 indicates a longitudinally elongated shape having a long axis arranged in the vertical direction.

DESCRIPTION OF THE PREFERRED EMBODIMENTS

The reason that a cathode ray tube of the present invention can realize favorable focusing over the whole area of a screen is explained hereinafter. In the cathode ray tube,when electron beam which is emitted from an electron gun is deflected by a deflection yoke, a beam spot shape on the screen is degraded due to the influence of aberration generated by a deflection magnetic field. The aberration of the deflection magnetic field gives rise to the larger influence particularly in the vertical direction. Further, the larger the diameter of electron beams within the deflection magnetic field, the influence becomes larger and hence, the beam spot shape on the screen is also eventually enlarged. Accordingly, to obtain the favorable beam sport shape in the periphery of the screen, it is necessary to decrease the influence of the aberration of the deflection magnetic field in the vertical direction of the electron beam by making the diameter in the vertical direction smaller than the diameter in the horizontal direction of the electron beam incident on the deflection magnetic field. That is, it is necessary to make the cross-sectional shape of the electron beam incident on the deflection magnetic field laterally-elongated.

Figure 10:
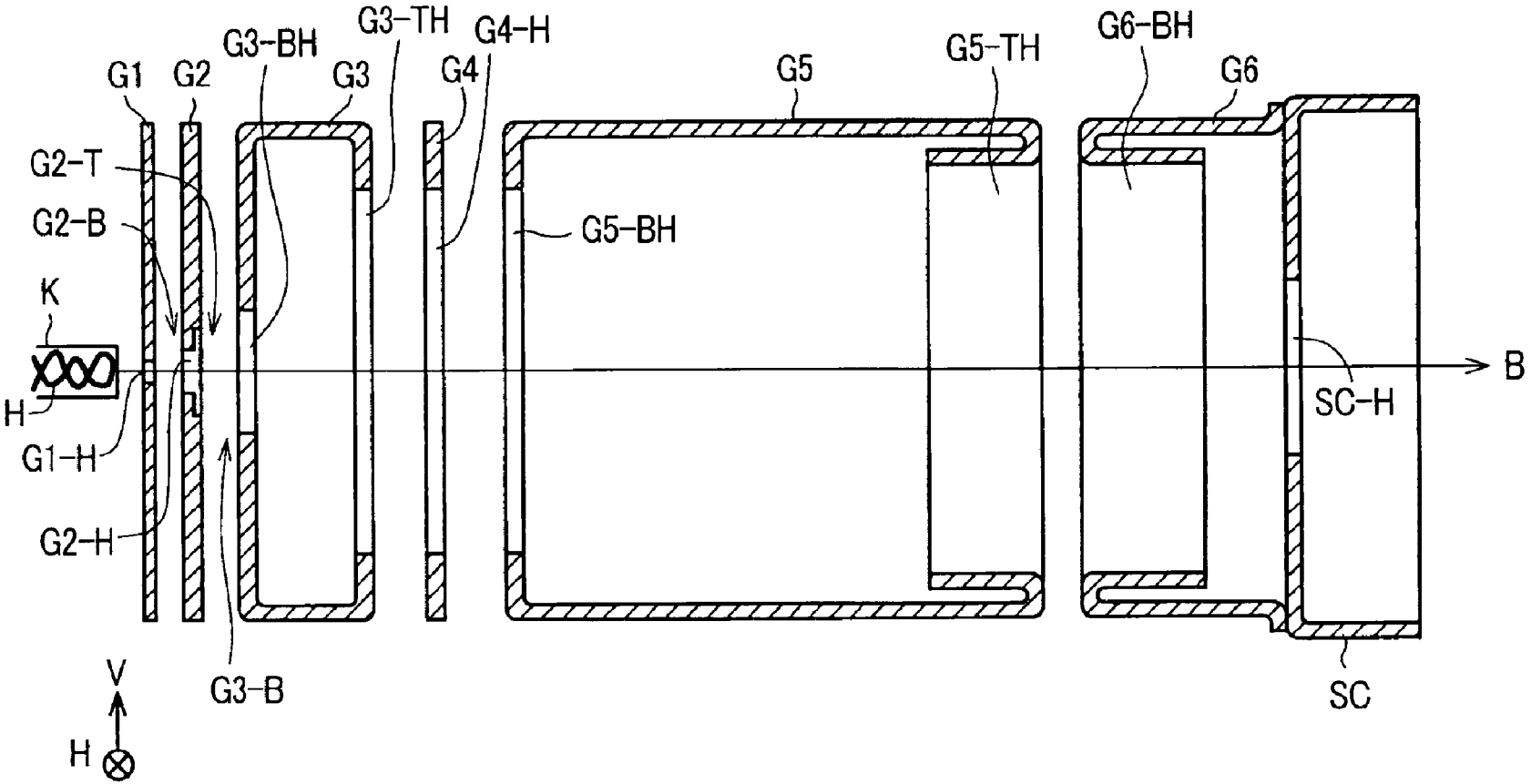
FIG. 10 (Prior Art)
FIG. 10 is a cross-sectional view of an electron gun in a conventional color cathode ray tube.
Figure 11A:
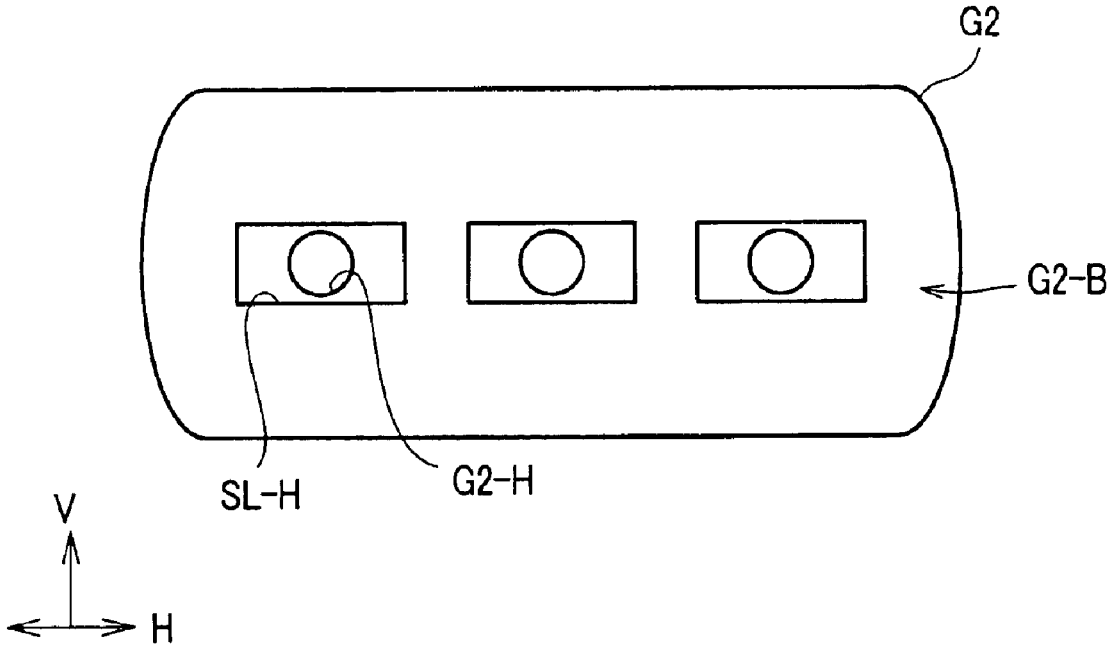
FIG. 11A (Prior Art)
FIG. 11A is a plan view of a second electrode in FIG. 10
Figure 11B:
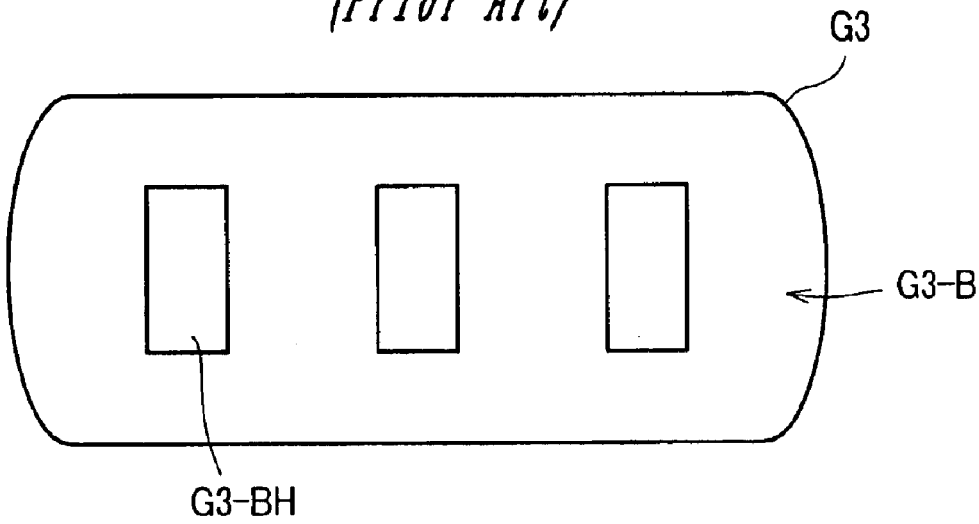
FIG. 11B (Prior Art)
FIG. 11B is a plan view of a third electrode in FIG. 10.

As means to make the cross-sectional shape of the electron beam incident on the deflection magnetic field laterally-elongated, in the conventional electron gun shown in FIG. 10, there has been known a method in which laterally-elongated concave are formed at a top of the second electrode G2 while surrounding electron beam apertures or bottom electron beam apertures formed in the third electrode G3 are longitudinally elongated. However, since a crossover position of a peripheral portion of the electron beam having low current density (outside of the cross section of beam: halo portion) is arranged closer to a cathode K side than the second electrode G2, due to an action of the longitudinally elongated concave formed at the top of the second electrode G2, the cross-section of the halo portion is laterally elongated. However, a crossover position of a center portion of the electron beam having high current density (a center portion of the cross section of beam: core portion) is arranged in the vicinity of the second electrode G2 or is arranged closer to the third electrode G3 side than the second electrode G2 and hence, the lateral elongation effect generated by the longitudinally elongated concave formed at the top of the second electrode G2 is not obtained or, to the contrary, such a structure functions to make the electron beam longitudinally elongated. Accordingly, the core portion of the electron beam having the longitudinally elongated cross section largely receives the influence of deflection aberration at the periphery of the screen and hence, the luminance of halo portion of the beam spot is increased whereby the focusing is degraded.

To solve such a drawback, efforts have been made including the formation of laterally-elongated concave at the bottom of the second electrode G2 or the longitudinal elongation of the electron beam apertures formed in the bottom of the third electrode G3. Such a structure gives rise to an action in which the laterally-elongated concave formed at the bottom of the second electrode G2 make the cross-section of the core portion of the electron beam laterally-elongated and the longitudinally elongated electron beam apertures formed at the bottom of the third electrode G3 make the cross-section of the halo portion laterally elongated and hence, it is possible to obtain an advantageous effect that both cross-sectional shapes of the core portion and the halo portion of the electron beam incident on the inside of the deflection magnetic field are laterally elongated.

However, when the concave are formed in the second electrode G2, corresponding to an amount of the depth of the concave (a fall amount in the thickness direction), a distance between the electron beam aperture G1-H of the first electrode G1 and the electron beam aperture G2-H of the second electrode G2 is increased and hence, the beam spot diameter at the center portion of the screen is enlarged whereby the resolution is degraded. Particularly, since the vertical-direction diameter of the electron beam is made small to reduce the influence of the deflection aberration, the vertical-direction diameter of the beam spot is enlarged whereby the resolution of the display of lateral lines at the center of the screen is degraded. Further, when the distance between the electron beam aperture G1-H of the first electrode G1 and the electron beam aperture G2-H of the second electrode G2 is increased, the dependency of the focusing voltage on the current is increased whereby the degradation of focusing at the low luminance or the high luminance is increased.

Accordingly, without forming the concave in the bottom of the second electrode G2, the longitudinally elongated concave is formed in the top of the second electrode G2. Due to such a constitution, the cross-sectional shape of the core portion of the electron beam can be laterally elongated. Further, since the concave is not formed in the bottom of the second electrode G2, the distance between the electron beam aperture G1-H of the first electrode G1 and the electron beam aperture G2-H of the second electrode G2 can be narrowed. However, with the longitudinally elongated concave formed in the top of the second electrode G2, the cross-sectional shape of the beam spots in the peripheral portion of the screen is not laterally elongated. Accordingly, by forming the electron beam aperture formed in the bottom of the third electrode G3 into a longitudinally elongated shape, it is possible to make the cross-sectional shape of the beam spot in the peripheral portion of the screen laterally elongated.

In this manner, by combining the laterally-elongated concave formed in the top of the second electrode G2 and the longitudinally-elongated electron beam aperture formed in the bottom of the third electrode G3, it is possible to make both of the core portion and the halo portion of the electron beam incident on the inside of the deflection magnetic field have the laterally-elongated cross-section, whereby the degradation of the beam-spot shape in the peripheral portion of the screen can be suppressed. Further, due to narrowing of the distance between the electron beam aperture G1-H formed in the first electrode G1 and the electron beam aperture G2-H formed in the second electrode G2, the degradation of the beam spot diameter at the center portion of the screen can be suppressed.

Further, due to narrowing of the distance between the electron beam aperture G1-H formed in the first electrode G1 and the electron beam aperture G2-H formed in the second electrode G2, the dependency of the focusing voltage on the current can be decreased whereby focusing at the low luminance or the high luminance can be enhanced. Further, due to narrowing of the distance between the electron beam aperture G1-H formed in the first electrode G and the electron beam aperture G2-H formed in the second electrode G2, the tolerance of the cut-off voltage can be increased, a voltage applied to the second electrode G2 and the fourth electrode G4 (EC2 described later) can be decreased so that a lens between the second electrode G2 and the third electrode G3 can be intensified whereby the focusing characteristics can be enhanced.

Further, in place of making the electron beam aperture formed in the bottom of the third electrode G3 longitudinally elongated, the substantially same advantageous effect can be obtained by providing longitudinally elongated concave to the electron beam aperture formed in the third electrode G3. Further, by increasing the cathode loading in the vertical direction by making the electron beam aperture formed in the first electrode G1 have the laterally elongated shape, the diameter in the vertical direction of the beam spot on the screen can be reduced whereby the resolution of the display of the lateral line at the center of the screen can be enhanced. Further, by forming the electron beam aperture of the first electrode G1 into a longitudinally elongated shape and by forming the cross section of the electron beam incident on the inside of the deflection magnetic field into a further laterally elongate shape, the shape of the beam spot in the periphery of the screen can be enhanced.

Here, it is needless to say that the present invention is not limited to the above-mentioned constitution and the constitutions of embodiments and various modifications can be made without departing from the technical concept of the present invention.

Hereinafter, the embodiments of the present invention are explained in detail in conjunction with drawings of the embodiments.

Figure 1:
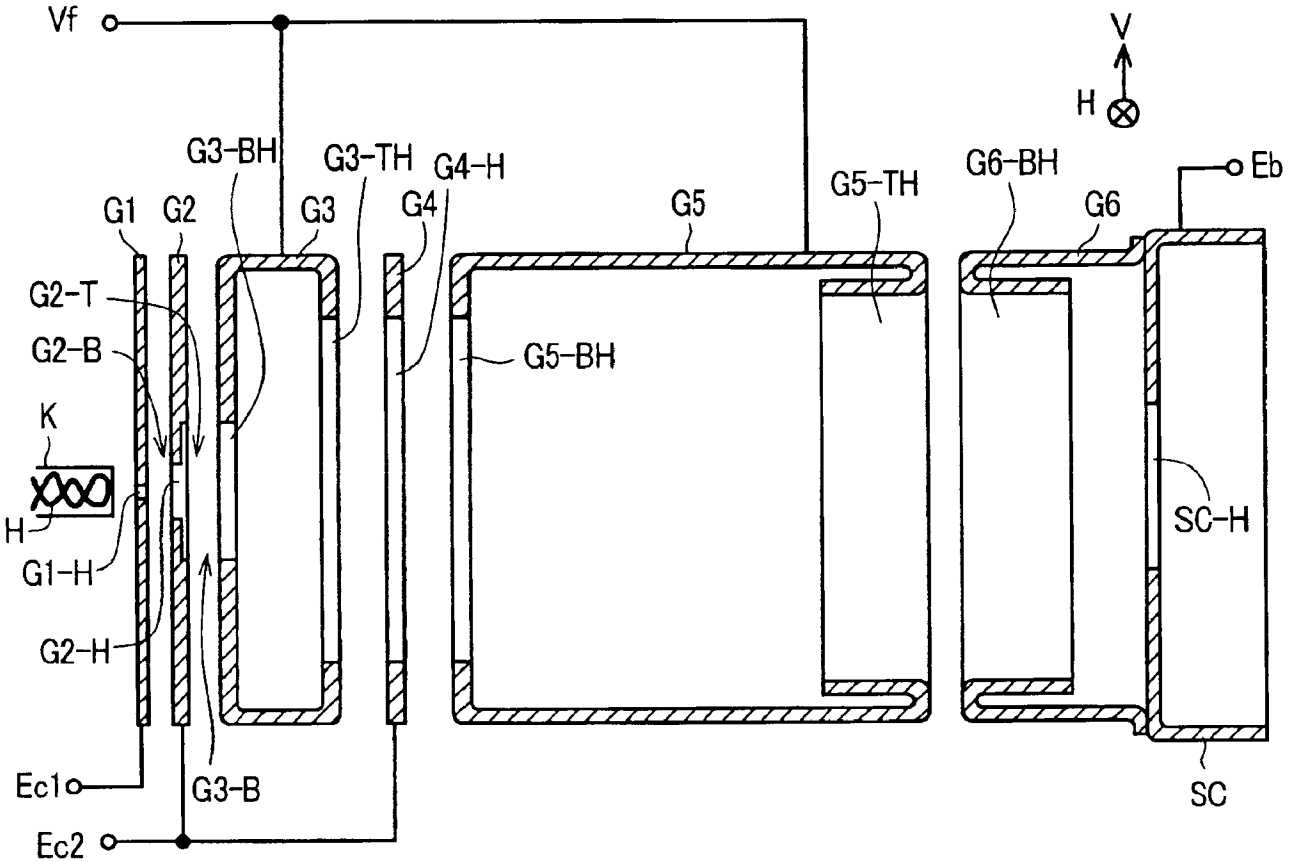
FIG. 1 is a cross-sectional view for explaining one constitutional example of an electron gun provided to a color cathode ray tube according to the present invention.

FIG. 1 is a schematic cross-sectional view for explaining one constitutional example of an electron gun provided to a cathode ray tube according to the present invention. In the drawing, an electron beam generating part (a triode part) is comprised of a cathode K which is heated by a heater H, a first electrode G1 which constitutes a control electrode and a second electrode G2 which constitutes an accelerating electrode. The electron beams generated by the triode part passes through a pre-focusing lens which is constituted of a third electrode G3, a fourth electrode G4 and a fifth electrode G5 and, thereafter, are radiated toward a phosphor screen through a main focusing lens which is formed between the fifth electrode G5 and a sixth electrode G6 which constitutes an anode. Here, SC indicates a shielding cup. FIG. 1 shows a cross section in the vertical direction (longitudinal direction) V along a center electron beam path among electron beam paths which are arranged in parallel in the horizontal direction (lateral direction) H.

Reference symbol G1-H indicates an electron beam aperture of the first electrode G1, reference symbol G2-H indicates electron beam apertures of the second electrode G2, reference symbol G3-BH indicates electron beam apertures formed in the second electrode G2 side of the third electrode G3, that is, electron beam apertures formed in a bottom of the third electrode, reference symbol G3-TH indicates electron beam apertures formed in the fourth electrode G4 side of the third electrode G3, that is, electron beam apertures formed in a top of the third electrode, reference symbol G4-H indicates electron beam apertures formed in the fourth electrode G4, reference symbol G5-BH indicates electron beam apertures formed in the fourth electrode G4 side of the fifth electrode G5, that is, electron beam apertures formed in a bottom of the fifth electrode, reference symbol G5-TH indicates electron beam apertures formed in the sixth electrode G6 side of the fifth electrode G5, that is, electron beam apertures formed in a top of the fifth electrode, reference symbol G6-BH indicates electron beam apertures formed in the fifth electrode G5 side of the sixth electrode G6, that is, electron beam apertures formed in a bottom of the sixth electrode, and reference symbol SC-H indicates electron beam apertures formed in the shielding cup SC. Further, reference symbol Vf indicates a focusing voltage applied to the third electrode G3 and the fifth electrode G5, reference symbol Ec1 indicates a voltage applied to the first electrode G1, reference symbol Ec2 indicates a voltage applied to the second electrode G2 and the fourth electrode G4, and reference symbol Eb indicates an anode voltage.

Figure 2:
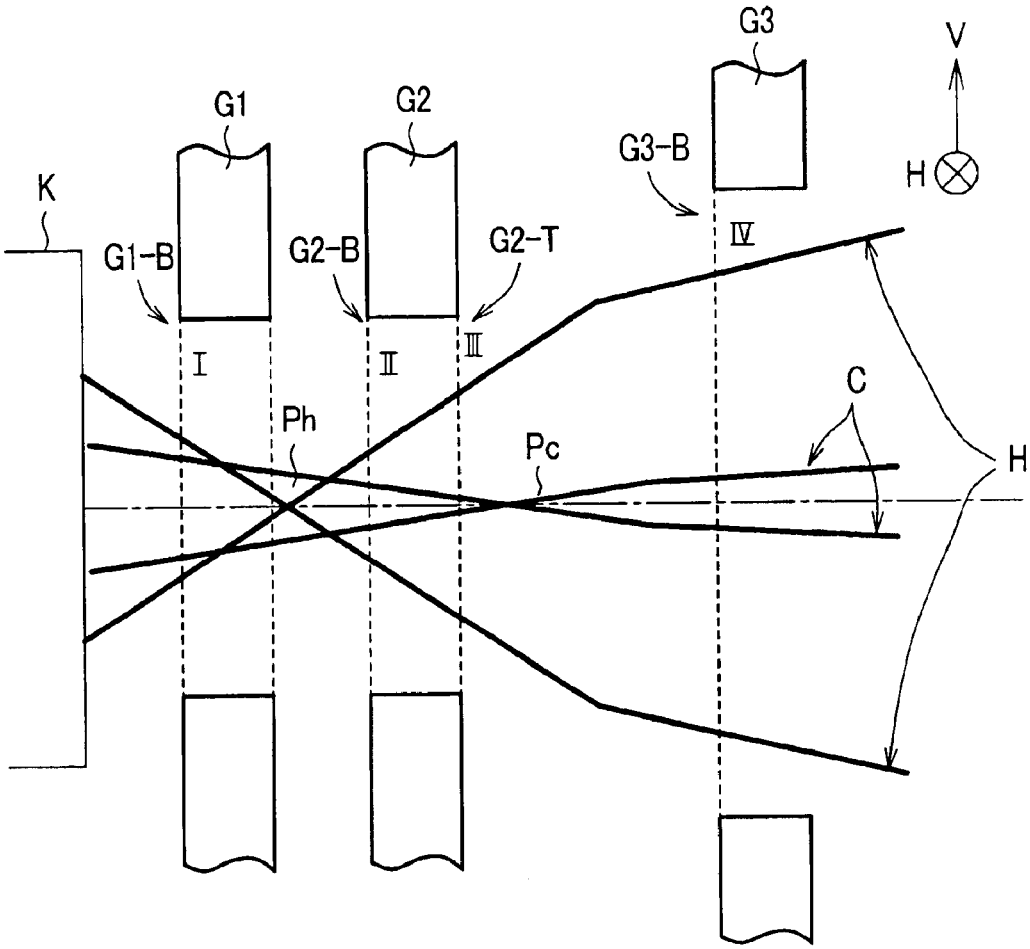
FIG. 2 is a schematic view for explaining loci of electron beams in the electrode constitution of the electron gun which constitutes the color cathode ray tube of the present invention.

FIG. 2 is a schematic view for explaining loci of electron beams in the electrode constitution of the electron gun which constitutes the color cathode ray tube of the present invention, and is a cross-sectional view in the vertical direction from the electron emitting portion of the cathode K to the third electrode G3. Symbols which are equal to those in FIG. 1 indicate identical functional parts. I to IV in the drawing show positions of the electrode which correspond to the cross-sectional shapes of the electron beams described later. In FIG. 2, the electrons which are pulled out from the cathode K pass through the first electrode G1→the second electrode G2→the third electrode G3→the fourth electrode G4 and, thereafter, are radiated from the main lens which is formed between the fifth electrode G5 and the sixth electrode G6 in FIG. 1.

The electron beam has a core portion which constitutes a center portion of the electron beam having high current density and a halo portion which constitutes a peripheral portion of the electron beam having low current density, wherein an outer periphery of the core portion as viewed in the cross-section of the beam is indicated by a locus C of the core portion and a locus of an outer periphery of the halo portion as viewed in the cross section of the beam is indicated by a locus H of the halo portion. The halo portion has a crossover point Ph between the first electrode G1 and second electrode G2, while the core portion has a crossover point Pc between the second electrode G2 and the third electrode G3. On the screen, the core portion forms a high luminance portion and a halo portion forms a beam spot having low luminance.

Figure 3A:
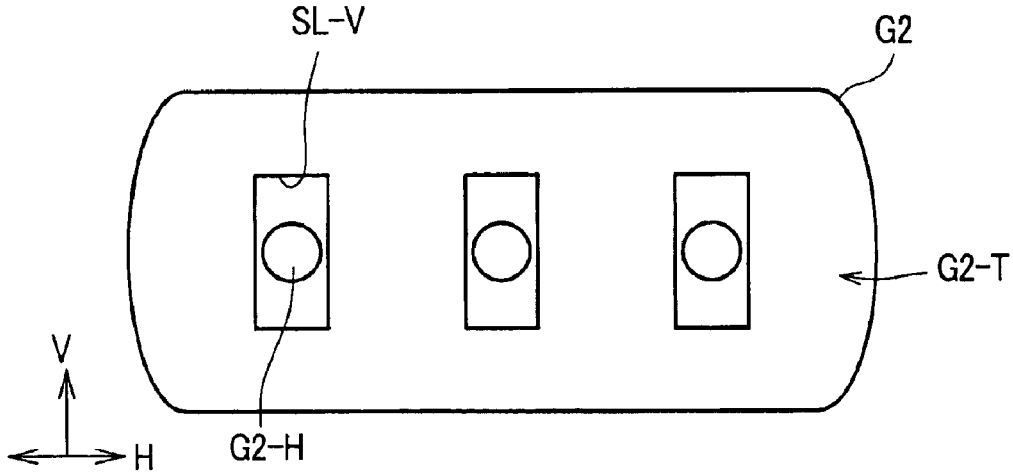
FIG. 3A is a plan view of a second electrode used in the cathode ray tube of the present invention and FIG. 3B is a plan view of a third electrode used in the cathode ray tube of the present invention.
Figure 3B:
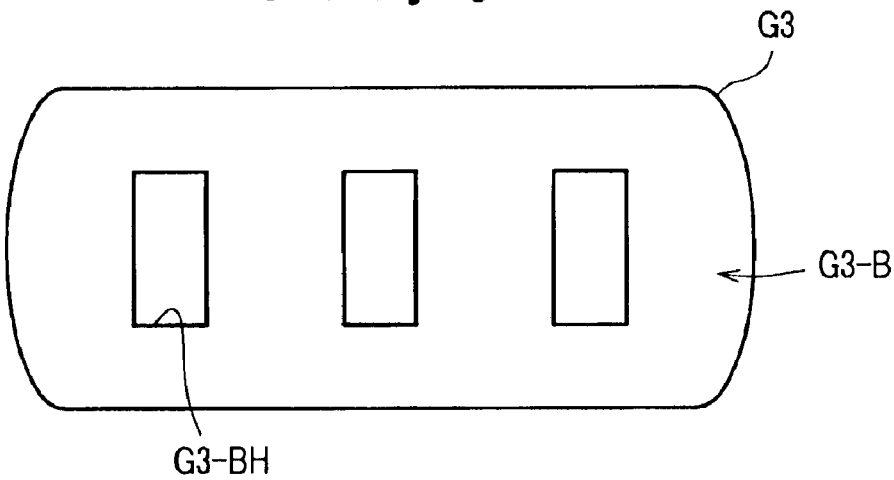

FIG. 3A and FIG. 3B are schematic plan views for explaining the constitutions of the second electrode and the third electrode of the electron gun for explaining the first embodiment of the present invention. FIG. 3A is a plan view of the third electrode G3 side of the second electrode G2, that is, the top side of the second electrode and FIG. 3B is a plan view of the second electrode G2 side of the third electrode G3, that is, the bottom side of the third electrode. In the top G2-T of the second electrode G2, longitudinally elongated concave SL-V which surround the electron beam apertures G2-H and have a long axis in the vertical direction are formed. On the other hand, in the bottom G3-B of the third electrode G3, longitudinally elongated electron beam apertures G3-BH having a long axis in the vertical direction V are formed.

Figure 4:
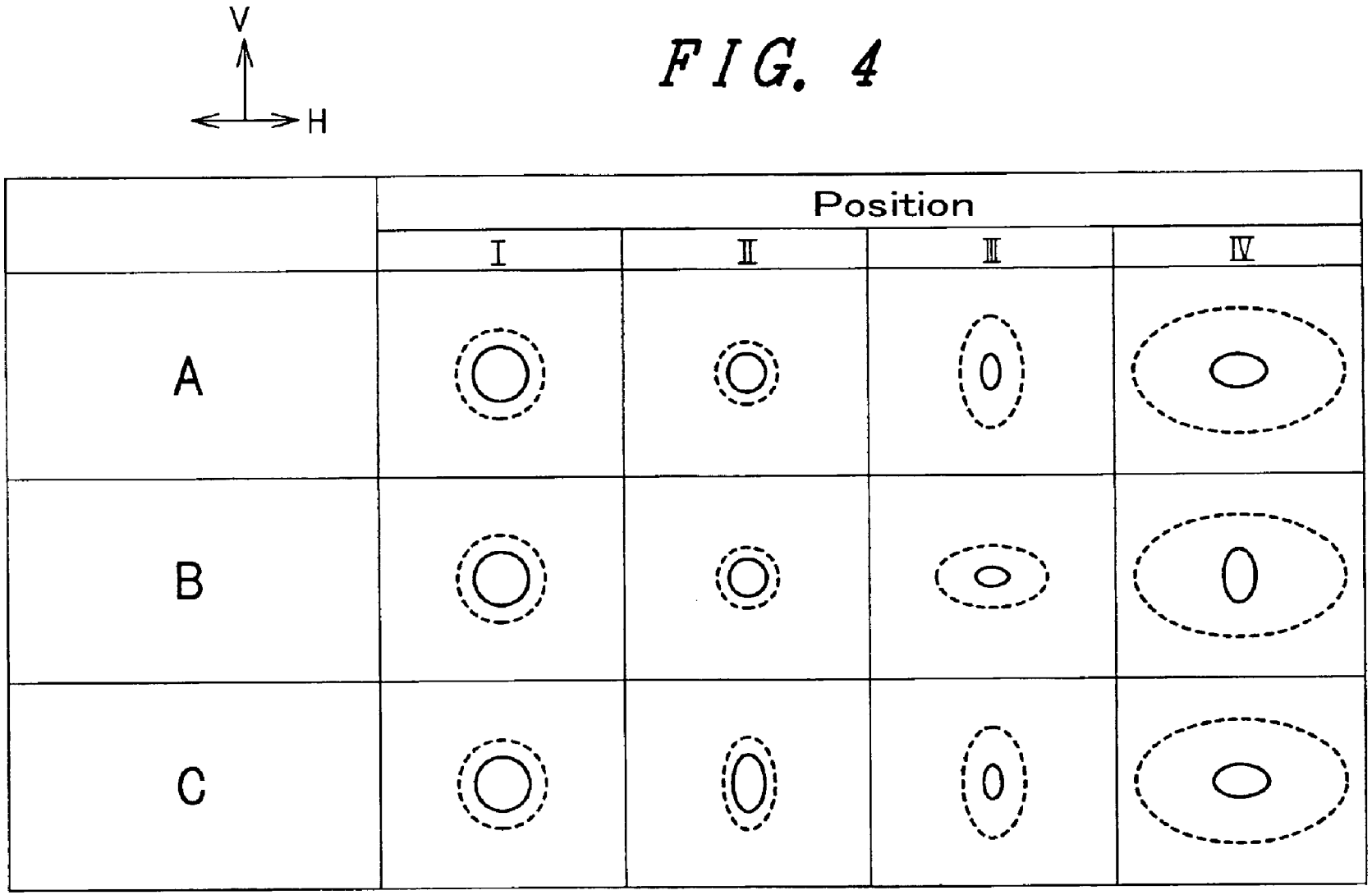
FIG. 4 is an explanatory view of cross-sectional shapes of electron beams at positions of respective electrodes shown in FIG. 2.

FIG. 4 is an explanatory view of the cross-sectional shapes of the electron beams at respective positions of the electrode shown in FIG. 2. In FIG. 4, reference symbol A indicates cross sections of the electron beams at respective positions (I–IV) in FIG. 2 when the electrode constitution of the first embodiment of the color cathode ray tube according to the present invention explained in FIG. 3 is adopted. That is, reference symbol A indicates the cross-sections of the electron beams when the electrodes having the longitudinal concave in the third electrode G3 side surface of the second electrode G2 and the longitudinally elongated electron beam aperture in the surface of the third electrode G3 which faces the second electrode G2 in an opposed manner are used. Reference symbol B indicates cross sections of the electron beams at respective positions (I–IV) in FIG. 2 of the electron gun of the first example of the conventional color cathode ray tube. That is, reference symbol B indicates cross-sections of the electron beams when the electrodes having lateral concave in the third electrode G3 side surface of the second electrode G2 and the longitudinally elongated electron beam apertures in a surface of the third electrode G3 which faces a surface of the second electrode G2 in an opposed manner are used. Reference numeral C indicates cross sections of the electron beams at respective positions (I–IV) in FIG. 2 of the electron gun of the second example of the conventional color cathode ray tube. That is, reference symbol C indicates cross-sections of the electron beams when the electrodes having lateral concave on the first electrode G1 side surface of the second electrode G2 and the longitudinally elongated electron beam apertures in a surface of the third electrode G3 which faces the second electrode G2 in an opposed manner are used. Here, in the drawing, solid lines in the cross sections of the electron beams indicate the core portions and dotted lines in the cross sections of the electron beam indicate halo portions.

As indicated by the reference symbol A in FIG. 4, due to the constitutions of the second electrode G2 and the third electrode G3 as explained in conjunction with FIG. 3, at the position I of the bottom of the first electrode G1 and at the position II of the bottom of the second electrode G2, both of the core portion and the halo portion have an approximately circular shape, while at the position III of the top of the second electrode G2, both of the core portion and the halo portion have the longitudinally elongated shape. Further, at the position IV of the bottom of the third electrode G3, both of the core portion and the halo portion have the laterally elongated shape.

On the other hand, in the combination of the constitution in which the laterally-elongated concave are formed in the top of the second electrode G2 and the constitution in which the longitudinally elongated electron beam apertures are formed in the bottom of the third electrode G3, the electron beams have the cross-sections as indicated by reference symbol B in FIG. 4. That is, at the position I of the bottom of the first electrode G1 and at the position II of the bottom of the second electrode G2, the core portion and the halo portion have the approximately circular cross-section, while at the position III of the top of the second electrode G2, both of the core portion and the halo portion have the laterally elongated cross-sectional shape. Further, at the position IV of the bottom of the third electrode G3, the core portion has the longitudinally elongated cross section and the halo portion has the laterally elongated cross-sectional shape. As mentioned previously, with such constitutions, focusing at the peripheral portion of the screen is degraded.

Further, in the combination of the constitution in which the laterally-elongated concave are formed in the bottom of the second electrode G2 and the constitution in which the longitudinally elongated electron beam apertures are formed in the bottom of the third electrode G3, the electron beams have the cross-sections as indicated by reference symbol C in FIG. 4. That is, although at the position I of the bottom of the first electrode G1, the core portion and the halo portion have approximately circular cross section, at the position II of the bottom of the second electrode G2, the both of the core portion and the halo portion have the longitudinally elongated cross section. At the position III of the top of the second electrode G2, both of the core portion and the halo portion have the longitudinally elongated cross-sectional shape, while at the position IV of the bottom of the third electrode G3, both of the core portion and the halo portion have the laterally elongated cross-sectional shape. With such constitutions, the distance between the second electrode G2 and the first electrode G1 defined by forming the concave in the bottom of the second electrode G2 is increased and hence, the above-mentioned current dependency is increased.

In view of the above, by making the second electrode G2 and the third electrode G3 have the constitutions of this embodiment explained in conjunction with FIG. 3, the core portion and the halo portion can obtain the cross-sectional shapes indicated by reference symbol A in FIG. 4 at the position IV of the bottom of the third electrode G3 and, at the same time, the distance between the first electrode G1 and the second electrode G2 can be made small and hence, favorable focusing can be achieved over the whole area of the screen. Further, the current dependency of the focusing voltage can be made small and hence, focusing at the low luminance or at the high luminance can be enhanced. Still further, since the distance between the electron beam apertures G1-H of the first electrode G1 and the electron beam apertures G2-H of the second electrode G2 can be narrowed, the tolerance of the cut-off voltage can be increased whereby the voltage applied between the second electrode G2 and the fourth electrode G4 (EC2 explained later) can be reduced. Accordingly, a lens between the second electrode G2 and the third electrode G3 can be intensified thus providing the color cathode ray tube having enhanced focusing characteristics.

Figure 5:
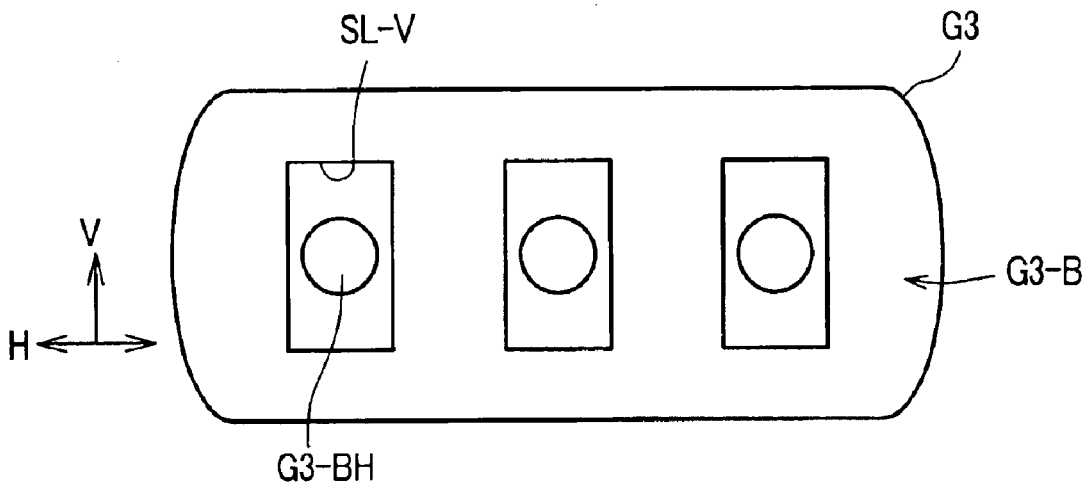
FIG. 5 is a view showing the second embodiment of the present invention and is a plan view of a third electrode of an electron gun.

FIG. 5 is a schematic plan view for explaining the constitution of the third electrode of the electron gun for explaining the second embodiment of the present invention. The second electrode G2 of this embodiment is substantially equal to the second electrode G2 shown in FIG. 3, while the longitudinally elongated concave SL-V which surround the electron beam apertures G3-BH and have a long axis in the vertical direction V are formed in the bottom G3-B of the third electrode G3. Due to such a constitution, it is also possible to obtain the substantially equal advantageous effects as those of the above-mentioned first embodiment.

Figure 6:
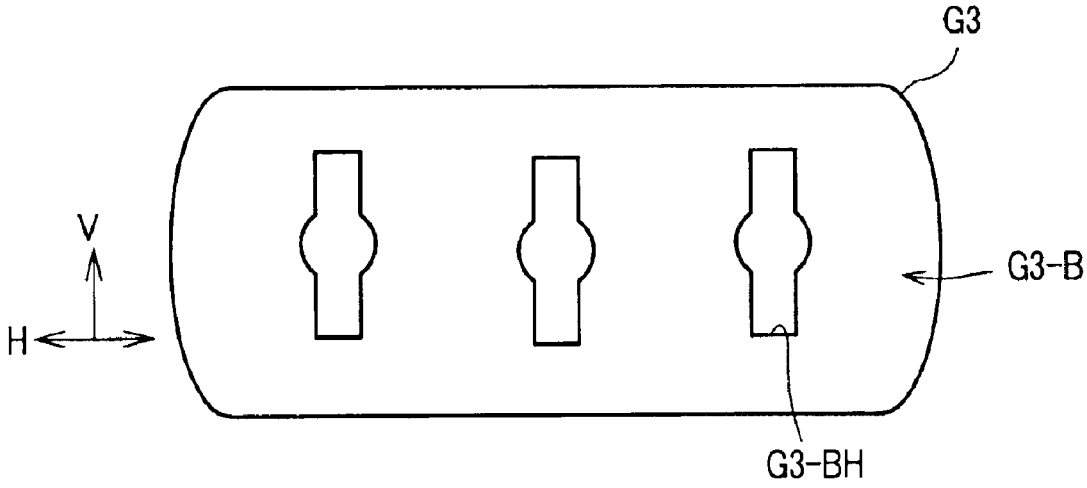
FIG. 6 is a view showing the third embodiment of the present invention and is a plan view of a third electrode of an electron gun.

FIG. 6 is a schematic plan view for explaining constitution of the third electrode of the electron gun for explaining the third embodiment of the present invention. The second electrode G2 of this embodiment is substantially equal to the second electrode G2 shown in FIG. 3, while the electron beam apertures G3-BH each having a long axis in the vertical direction V and having a longitudinally-elongated key-hole shape (a shape formed by combining a rectangular shape and a circular shape) are formed in the bottom G3-B of the third electrode G3. Due to such a constitution, it is also possible to obtain the substantially same advantageous effects as those of the first embodiment.

Figure 7:
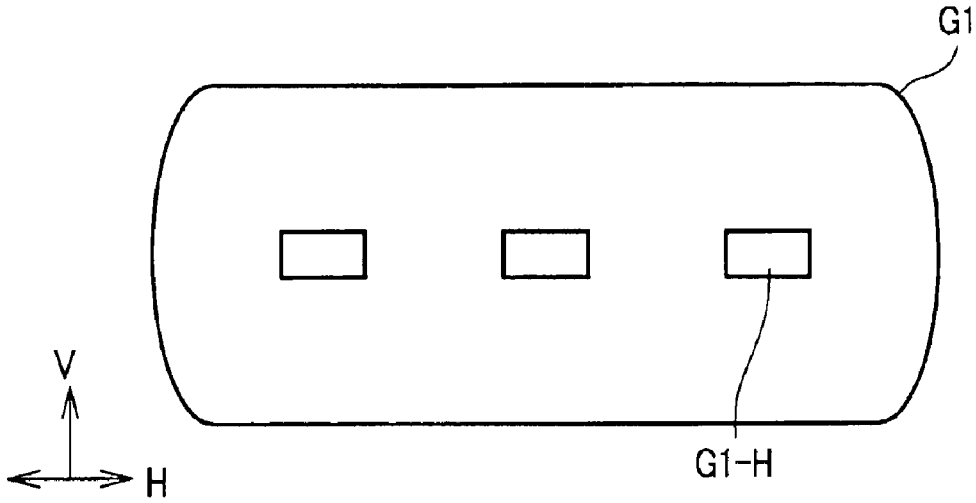
FIG. 7 is a view showing the fourth embodiment of the present invention and is a plan view of a first electrode of an electron gun.

FIG. 7 is a schematic plan view for explaining the constitution of the first electrode of the electron gun for explaining the fourth embodiment of the present invention. In this embodiment, the electron beam apertures of the first electrode are laterally elongated and this first electrode is combined with either one of the second electrode G2 and the third electrode G3 explained in conjunction with the above-mentioned first to third embodiments. According to this embodiment, the cathode loading in the vertical direction is enhanced and the diameter of the beam spot in the vertical direction is narrowed whereby the resolution of the display of the lateral line at the center of the screen can be enhanced.

Figure 8:
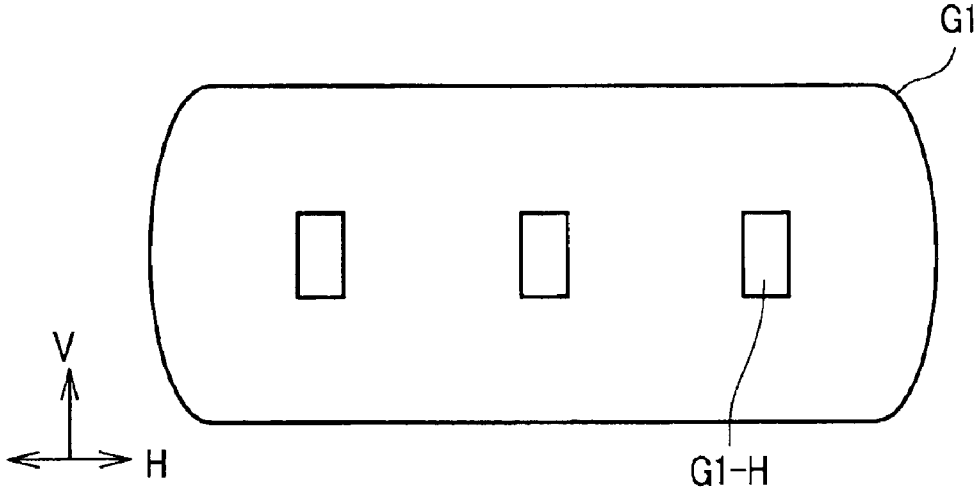
FIG. 8 is a view showing the fifth embodiment of the present invention and is a plan view of a first electrode of an electron gun.

FIG. 8 is a schematic plan view for explaining the constitution of the first electrode of the electron gun for explaining the fifth embodiment of the present invention. In this embodiment, the electron beam apertures of the first electrode are laterally elongated and this first electrode is combined with either one of the second electrode G2 and the third electrode G3 explained in conjunction with the above-mentioned first to third embodiments. According to this embodiment, by making the electron beam incident on the inside of the deflection magnetic field further laterally elongated, the shape of the beam spots in the peripheral portion of the screen can be enhanced.

Figure 9:
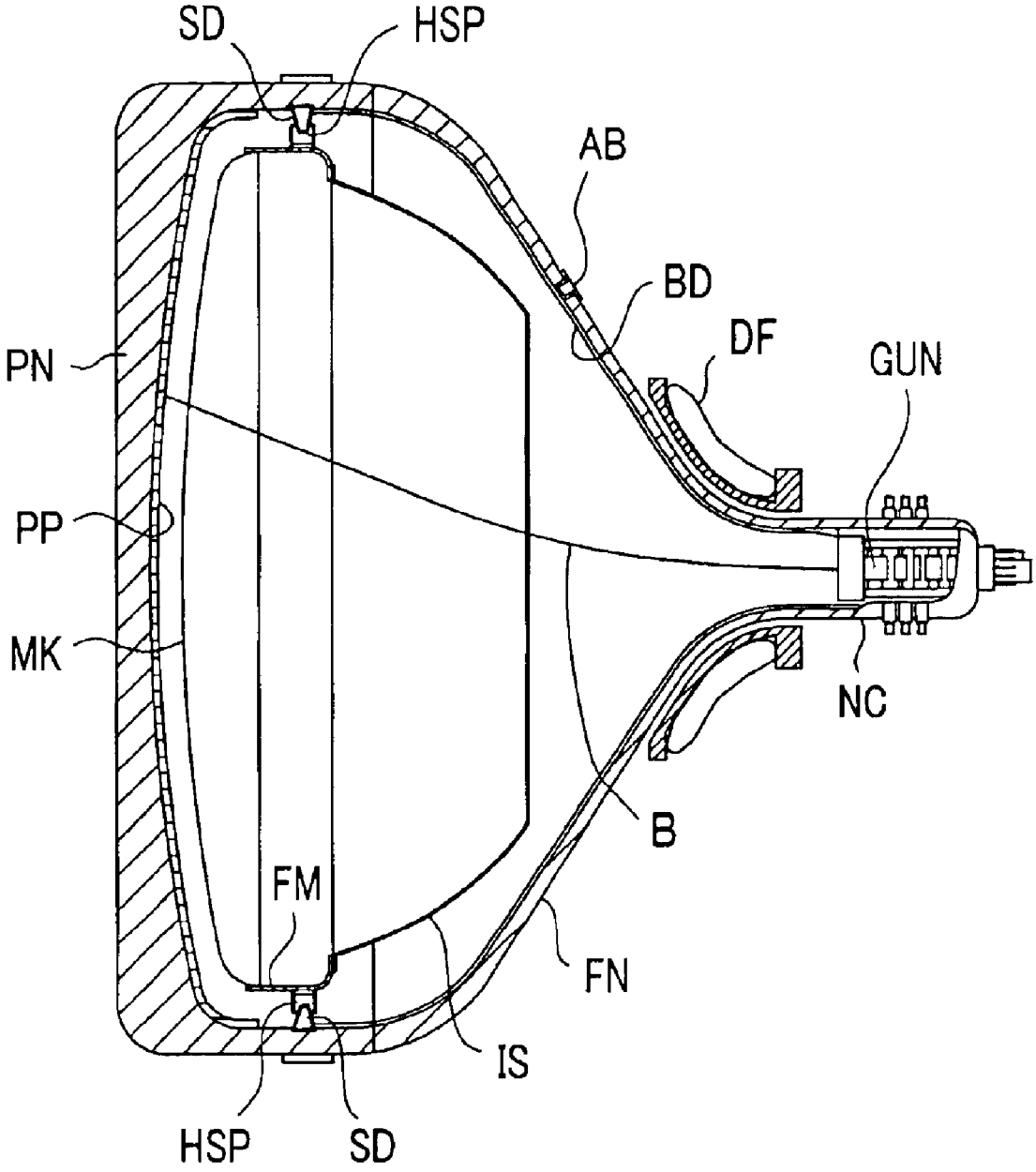
FIG. 9 is a cross-sectional view of the color cathode ray tube of the present invention.

FIG. 9 is a schematic cross-sectional view for explaining the constitutional example of the color cathode ray tube according to the present invention. In the drawing, a panel PN is joined to a large-diameter periphery which constitutes one end of a funnel FN and another end of the funnel FN which is formed by gradually narrowing the diameter in a funnel shape is joined to a neck NC. Three-colored phosphors (red, green, blue) having different coloring characteristics are applied to an inner surface of the panel PN to form a phosphor screen PP. A curved surface formed on an outer surface of the panel PN exhibits a substantially large planar shape having an equivalent radius of curvature of 8,000 mm to 10,000 mm, for example, wherein the equivalent radius of curvature of a curved surface on the inner surface is set smaller than the equivalent radius of curvature of the outer surface for holding the mechanical strength of a glass envelope.

A shadow mask MK having a large number of beam apertures is arranged close to the phosphor screen PP formed on the inner surface of the panel PN. The shadow mask MK is welded to a mask frame FM and is supported such that mask frame FM is engaged with studs SD which are mounted on an inner surface of side walls of the panel in an erected manner by a suspension mechanism HSP. On the electron gun GUN side of the mask frame FM, a magnetic shield IS is mounted for blocking an electron beam flux B from an external magnetism such as an earth magnetism.

An anode button AB for introducing a high voltage (an anode voltage) from the outside is mounted on a side wall of the funnel FN. An inner conductive film BD which is electrically connected with the anode button AB is applied to inner surfaces of the skirt portion of the panel PN and the funnel FN as well as to an inner surface of the front end of an electron gun housing portion of the neck NC. Through this inner conductive film BD, the high voltage (the anode voltage) which is applied from the anode button AB is introduced to the phosphor screen PP and the anode of the electron gun GUN.

Further, a deflection yoke DF is exteriorly mounted on the neck NC side of the funnel FN (a transitional area between the funnel FN and the neck NC). By deflecting an electron beam flux B in two directions consisting of the horizontal direction and the vertical direction by the deflection yoke DF, a two dimensional image is reproduced on the phosphor screen PP. Further, in the inside of the neck NC, the electron gun GUN which emits three electron beams in the direction toward the phosphor screen PP is housed.

In this manner, according to the above-mentioned respective embodiments of the present invention, the beam spot shape of the electron beam which pass through the deflection magnetic field on the phosphor screen can be optimized and hence, the color cathode ray tube which can realize the optimum focusing over the whole area of the phosphor screen can be obtained.

As has been explained heretofore, according to the present invention, in the electron gun which includes the triode part which is constituted of the cathode, the control electrode and the acceleration electrode and the focusing electrode and the anode are arranged in the direction toward the phosphor screen from this triode part, the longitudinally elongated concave are formed such that the concave surround the electron beam apertures, respectively, at the focusing electrode side of the acceleration electrode, and the longitudinally elongated electron beam apertures, the longitudinally elongated concave surrounding the electron beam apertures or the longitudinally elongated keyhole-shaped electron beam apertures are formed at the acceleration electrode side of the focusing electrode which faces the acceleration electrode. Accordingly, it is possible to provide the color cathode ray tube having the electron gun which can realize the favorable focusing over the whole area of the screen.

What is claimed is:

1. A color cathode ray tube comprising a vacuum envelope which includes a panel portion having a phosphor screen on an inner surface thereof, a neck portion housing an electron gun and a funnel portion connecting the panel portion and the neck portion, and a deflection yoke which is mounted on an outer portion where the neck portion is jointed to the funnel portion, wherein the electron gun includes a cathode, a control electrode, an acceleration electrode, a focusing electrode and an anode, the acceleration electrode includes a longitudinally elongated concave which surround an electron beam aperture on a surface thereof at the focusing electrode side, and an electron beam aperture formed in the focusing electrode at the acceleration electrode side have a longitudinally elongated shape.

2. A color cathode ray tube according to claim 1, wherein the electron beam aperture formed in the control electrode have a laterally elongated shape.

3. A color cathode ray tube according to the claim 1, wherein electron beam apertures formed in the control electrode have a longitudinally elongated shape.

4. A color cathode ray tube comprising a vacuum envelope which includes a panel portion having a phosphor screen on an inner surface thereof, a neck portion housing an electron gun and a funnel portion connecting the panel portion and the neck portion, and a deflection yoke which is mounted on an outer portion where the neck portion is jointed to the funnel portion, wherein the electron gun includes a cathode, a control electrode, an acceleration electrode, a focusing electrode and an anode, the focusing electrode includes a first focusing electrode, a second focusing electrode and a third focusing electrode, and a main focusing lens is formed between the third focusing electrode and the anode, the acceleration electrode includes longitudinally elongated concave which surround an electron beam aperture in a surface thereof at the first focusing electrode side, and an electron beam aperture formed in the first focusing electrode at the acceleration electrode side have a longitudinally elongated shape.

5. A color cathode ray tube according to claim 4, wherein the acceleration electrode includes longitudinally elongated concave which surround an electron beam aperture in a surface thereof at the first focusing electrode side, and the first focusing electrode has longitudinally elongated concave which surround an electron beam aperture in a surface thereof at the acceleration electrode side.

6. A color cathode ray tube according to claim 4, wherein the electron beam aperture formed in the control electrode is formed in a laterally elongated shape having a long axis in the horizontal direction.

7. A color cathode ray tube according to claim 4, wherein the electron beam aperture formed in the control electrode is formed in a longitudinally elongated shape having a long axis in the vertical direction.

8. A color cathode ray tube according to claim 5, wherein the electron beam aperture formed in the control electrode is formed in a laterally elongated shape having a long axis in the horizontal direction.

9. A color cathode ray tube according to claim 5, wherein the electron beam aperture formed in the control electrode is formed in a longitudinally elongated shape having a long axis in the vertical direction.

* * * * *